US011814829B2

(12) United States Patent
Downey

(10) Patent No.: US 11,814,829 B2
(45) Date of Patent: Nov. 14, 2023

(54) SHOWER HOSE MANAGEMENT

(71) Applicant: ASSA ABLOY Americas Residential Inc., New Haven, CT (US)

(72) Inventor: David Downey, Aliso Viejo, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 186 days.

(21) Appl. No.: 17/282,359

(22) PCT Filed: Sep. 30, 2019

(86) PCT No.: PCT/US2019/053834
§ 371 (c)(1),
(2) Date: Apr. 1, 2021

(87) PCT Pub. No.: WO2020/072368
PCT Pub. Date: Apr. 9, 2020

(65) Prior Publication Data

US 2021/0348371 A1 Nov. 11, 2021

Related U.S. Application Data

(60) Provisional application No. 62/740,241, filed on Oct. 2, 2018.

(51) Int. Cl.
*E03C 1/06* (2006.01)

(52) U.S. Cl.
CPC ..... *E03C 1/06* (2013.01)

(58) Field of Classification Search
CPC ..... E03C 1/06
USPC ..... 4/567, 568, 570, 596, 601, 615, 618
See application file for complete search history.

(56) References Cited

U.S. PATENT DOCUMENTS 3,471,872 A * 10/1969 Symmons ..... E03C 1/0408 4/570
4,809,369 A * 3/1989 Bowden ..... E03C 1/06 4/596
9,707,574 B2 * 7/2017 Soetaert ..... E03C 1/0408
2002/0116757 A1 * 8/2002 Gransow ..... E03C 1/06 4/567

(Continued)

FOREIGN PATENT DOCUMENTS

CN 206716243 U 12/2017
FR 2713301 A1 6/1995

OTHER PUBLICATIONS

International Search Report and Written Opinion for PCT/US2019/053834, dated Jan. 22, 2020.

(Continued)

*Primary Examiner* — Tuan N Nguyen
(74) *Attorney, Agent, or Firm* — Merchant & Gould P.C.

(57) ABSTRACT

A hose management system for a hand-shower includes a riser bar for attachment to a drop ear in a shower wall. The flexible hose includes a shower head and attaches to the riser bar, opposite the drop ear, and is held in place by a cradle. The cradle is attached to the riser bar and includes a U-shaped cross section that retains the hose within the valley of the cradle. The hose may be retained within the cradle, and used as a traditional shower, by an interference fit or by magnetic attraction. The hose may also be manually pulled out of the cradle, thereby allowing uninterrupted manipulation while using the shower head as a hand-shower.

20 Claims, 4 Drawing Sheets

(56) References Cited

U.S. PATENT DOCUMENTS

| | | | | |
|---|---|---|---|---|
| 2013/0248017 | A1 | 9/2013 | Neagoe | |
| 2015/0033470 | A1 | 2/2015 | Sharratt et al. | |
| 2015/0158047 | A1 | 6/2015 | Johnson et al. | |
| 2016/0215482 | A1* | 7/2016 | Fourman | E03C 1/0404 |
| 2016/0236223 | A1* | 8/2016 | Scheffer | E03C 1/06 |

OTHER PUBLICATIONS

Office Action and Search Report for TW108135675, dated Apr. 21, 2023 (5 pgs).

* cited by examiner

SHOWER HOSE MANAGEMENT

CROSS-REFERENCE TO RELATED APPLICATION

This application is a PCT International patent application No. PCT/US2019/053834, filed Sep. 30, 2019, which claims the benefit of priority to U.S. Provisional Application No. 62/740,241, filed Oct. 2, 2018, which applications are incorporated herein by reference. To the extent appropriate, a claim of priority is made to each of the above-disclosed applications.

TECHNICAL FIELD

This invention relates to the field of shower heads. In particular, the invention relates to a hand-held shower wand and hose management device that allows the shower wand to be used as a shower head.

BACKGROUND OF THE INVENTION

Hand-held shower wands are commonly used when showering. Hand-held shower wands provide an infinite amount of adjustability to the water delivery angle from the shower head. Hand-held shower wands also allow a bather to only wet certain body parts at a time. This is useful, for example, when leg shaving is desired but a full body shower is not desired.

Hand-held shower wands also allow a user to clean the shower wall efficiently without having to get oneself wet.

One way hand-held shower wands are implemented is with a diverter valve. The diverter valve allows a user to toggle between a traditional shower head and the hand-held shower wand.

Another way hand-held shower wands are implemented is with a docking mount that is either integral to the fixed shower head or proximate the fixed shower head on a slide bar or a wall. Such an implementation allows the user to mount the hand-held shower wand in a convenient location while it is not in use.

One common issue with hand-held shower wand implementations is that they introduce a great deal of clutter to the shower wall. Shower design aesthetics are increasingly important to the average homeowner. Slide bars, hand-shower docking mounts, diverter valves, and hoses all introduce an added level of clutter on the shower wall. Therefore, there is a need to implement a hand-shower wand without added clutter.

Another issue with known hand-held shower wands is difficulty with installing and operating the diverter valve. In-wall diverters require expensive plumbing work and opening of the shower wall. Diverters added to the shower head stub out connection are also not very aesthetically pleasing. As a result, there is a need for hand-shower wand implementation without expensive plumbing work or opening of the shower wall, while maintaining an aesthetically pleasing design.

SUMMARY OF THE INVENTION

The present disclosure relates generally to a hand-shower fixture. In one example of the present disclosure, the hand-shower fixture includes the following components. A water inlet extends from a drop ear. A vertically oriented riser bar with a length is joined to the water inlet at an upper end and braced to a shower wall at a lower end opposite the upper end. A hose attachment is connected to the lower end of the riser bar. A flexible hose is fluidly coupled to the hose attachment at a first end and is fluidly coupled to a shower head at a second end opposite the first end. A cradle is attached to the riser bar and is configured to engage the hose to keep the hose in a fixed position along at least a portion of the cradle.

In another example of the present disclosure, a hand-shower fixture is described. The hand-shower fixture includes: a water inlet configured to attach to an existing plumbing attachment in a shower wall; a linear, straight, and vertically oriented riser bar with a length joined to the water inlet with a right angle at an upper end and braced to a shower wall with a right angle at a lower end opposite the upper end; a hose attachment connected to the lower end of the riser bar with a swivel joint; a flexible hose that is fluidly coupled to the hose attachment at a first end and is fluidly coupled to a shower head at a second end, opposite the first end; and a cradle parallel to and attached to the riser bar with a substantially U-shaped cross section and a length configured to engage the hose with a magnetic attraction to keep the hose in a fixed position along at least a portion of the cradle.

In yet another example of the present disclosure, a hand-shower fixture is described. The hand-shower fixture includes a water inlet, a riser bar, a hose attachment, a flexible hose, and a cradle. The water inlet is configured to attach to an existing plumbing attachment in a shower wall. The rise bar is linear, straight, and vertically oriented, with a length joined to the water inlet with a right angle at an upper end and braced to a shower wall with a right angle at a lower end opposite the upper end. The hose attachment is connected to the lower end of the rise bar. The flexible hose is fluidly coupled to the hose attachment at a first end and is fluidly coupled to a shower head at a second end, opposite the first end. The cradle is parallel to and attached to the rise bar with a substantially U-shaped cross section.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
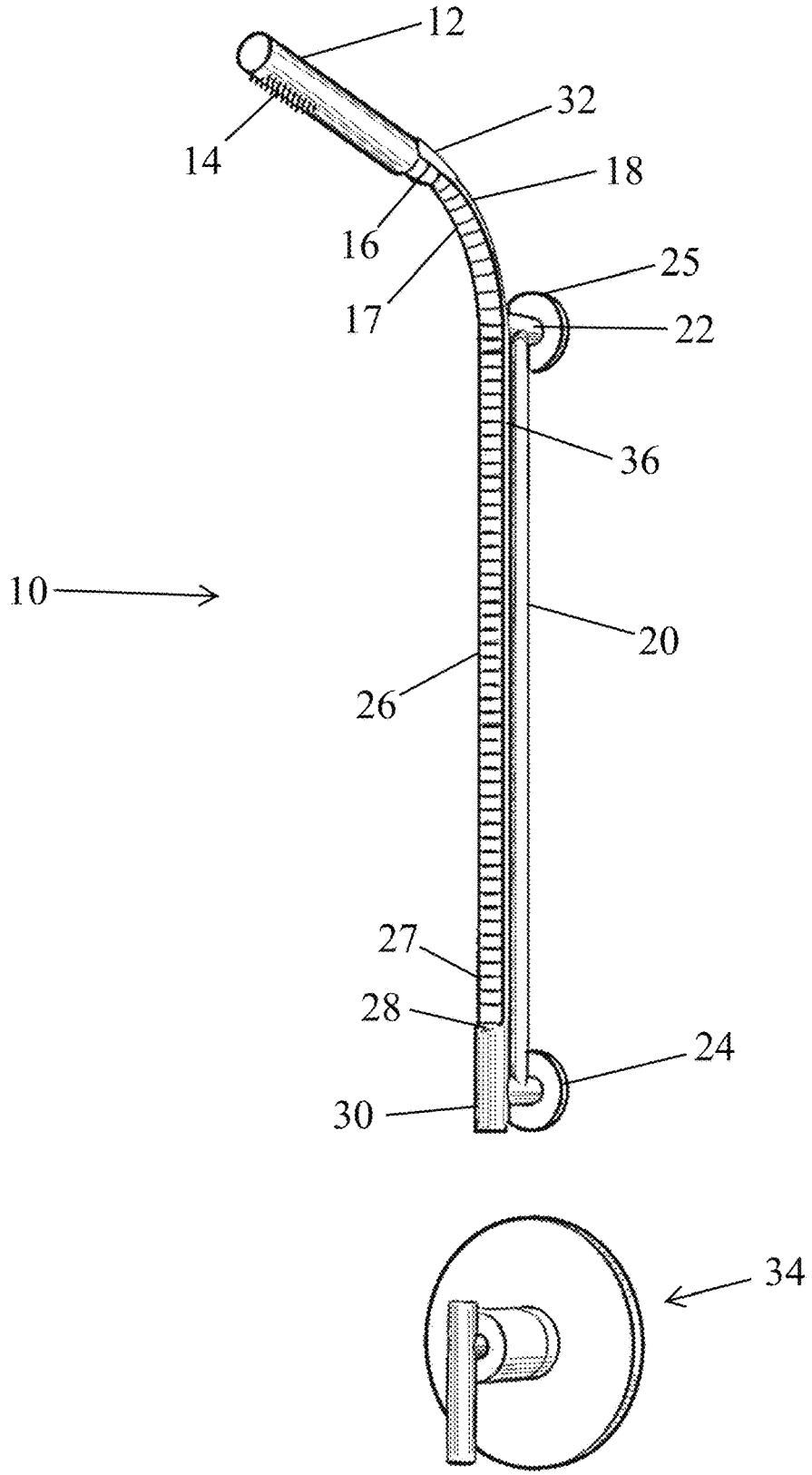
FIG. 1 shows a perspective view of a shower hose management invention.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A hand-shower fixture may include a water inlet extending from a pre-existing water supply within a shower wall such as a drop ear. A vertically oriented riser bar with a length is joined to the water inlet at an upper end and braced to a shower wall at a lower end, opposite the upper end.

A hose attachment is connected to the lower end of the riser bar where a flexible hose is joined. The opposite end of the hose is attached to a shower head. In order to properly retain the hose, a cradle is attached to the riser bar. The cradle is vertically oriented and extends along the length of the riser bar and engages the hose, thereby keeping the hose in a fixed position along the cradle. The hose may also be manually pulled out of the cradle allowing uninterrupted manipulation as the hose is only tethered to the riser bar at one end, opposite the shower head.

A curved portion on the cradle, located above the water inlet, positions the shower head away from the shower wall, thereby locating the shower head at a horizontal distance from the shower wall that is greater than the horizontal distance between the cradle and the shower wall. In other words, when the hose and the shower head are engaged by the cradle, the shower head is closer to a horizontal plane with respect to the vertically oriented riser bar.

The cradle may retain the hose with at least one magnet embedded into a portion of the cradle that magnetically attracts either one or both the hose and the shower head. The cradle also includes a substantially U-shaped cross section which can retain the hose with an interference fit of the hose into the U-shaped cradle.

The riser bar between the upper end and the lower end provides a pathway for water to flow through. The water enters the riser bar at the water inlet and flows into the hose attachment. From there, the water flows through the hose, into the shower head, and is dispensed therefrom.

In order to control the water flow, a valve may be provided that regulates the volume and temperature of the water delivered to the water inlet of the riser bar.

FIG. 1 shows a hose management fixture 10 that effectively manages a hose 26 for a shower head 12. The shower head 12, also commonly referred to as a hand-shower, may include any type of shower head 12. There are many different types of shower heads such as elongated, cylindrical, square, rectangular, and the like. All types of shower heads are included in the spirit of the inventive hand-shower cradle.

The hose 26 is retained by a cradle 36. The full length of the hose 26 is seated within the cradle 36 which effectively prevents the hose 26 from moving about the shower stall or otherwise looking unsightly. Typically, shower hoses are not retained along their full length which leads to curling of the hose, random movement, entanglement, and a disorderly appearance within the shower stall.

The cradle 36 is able to retain the hose 26 in a number of ways. Due to the cross-sectional shape of the cradle 36, the hose 26 is unable to move side to side. The cradle 36 may have a "C" or "U" cross-sectional shape with the hose 26 sitting in the valley. An interference fit may be employed, allowing a user to push the hose 26 into the cradle 36, or magnetism may be used. If magnetism is used, a series of magnets may be placed along the length of the cradle 36. The hose 26 may be constructed out of a magnetic material including a silicone or other synthetic material impregnated with magnetic material or a metallic material.

In order to deliver water to the shower head 12, an inlet 22 provides an entryway for water to enter the hose management fixture 10 at an upper end 25 of a riser bar 20. The water enters the inlet 22 and flows through the riser bar 20. The riser bar 20 is hollow and acts as a water conduit while also providing support to hold the cradle 36 and hose 26 in an upright orientation. The water flows through the length of the riser bar 20 and into a manifold 30 at a lower end 24 of the riser bar 20. The manifold 30 provides a hose attachment 28 to which the hose 26 attaches. The water is allowed to flow from the riser bar through the manifold 30, through the hose attachment 28, and into the hose 26. Preferably, the hose attachment 28 is a joint of some sort allowing the hose 26 to freely articulate. Some examples of such joints are ball joints, swivel joints, pivot balls, and the like. The hose attachment 28 is the only location where the hose 26 is tethered to the hose management fixture 10. As a result, the hose 26 is allowed to freely bend and move about when it is un-docked from the cradle 36.

The hose 26 is attached to the manifold 30 on a first end 27. On a second end 17, opposite the first end 27, the hose 26 is attached to the shower head 12 via a hose connection 16. In the region of the second end 17 of the hose 26, the cradle 36 forms a curved portion 18. The curved portion 18 of the cradle 36 may be curved in any form or direction. As shown in FIG. 1, the curved portion 18 bends the cradle 36 away from the axis of the riser bar 20 which allows for a straight shower head 12 to be used. In other words, the curvature of the curved portion 18 of the cradle 36 points nozzles 14 of the shower head 12 in a downwardly direction to emit a water stream below. Should a different type of shower head 12 be used, such as a curved shower head, a different angle of the curved portion 18 would be necessary to direct water flow from the nozzles 14 to a bathing user below. It is therefore foreseen that the curved portion 18 could be flexible, allowing the curved portion 18 to articulate and accommodate a wide variety of shower heads 12, each with a different geometry.

The hose management fixture 10 is operated as a standard hand-shower. Any valve 34 may be plumbed to control the water volume and water temperature delivered to the water inlet 22. As shown in FIG. 1, a pressure balancing valve 34 is used to control both the volume and temperature of the water. Alternatively, a thermostatic valve could be used with a separate volume control valve and/or diverter valve. Also, any combination of diverter, thermostatic, and pressure balancing valve could be used in the spirit of the invention to deliver water to the inlet 22. The water exits the shower head 12 through nozzles 14 on the shower head 12, but any type of nozzles may be employed.

The hose management fixture 10 is intended to act as a dual-purpose fixture as it functions like a standard, wall-mount shower head as well as a flexible hose-tethered hand-shower. The cradle 36 ensures the hose 26 remains neatly retained and stored, which produces a look similar to an exposed pipe shower.

Figure 2:
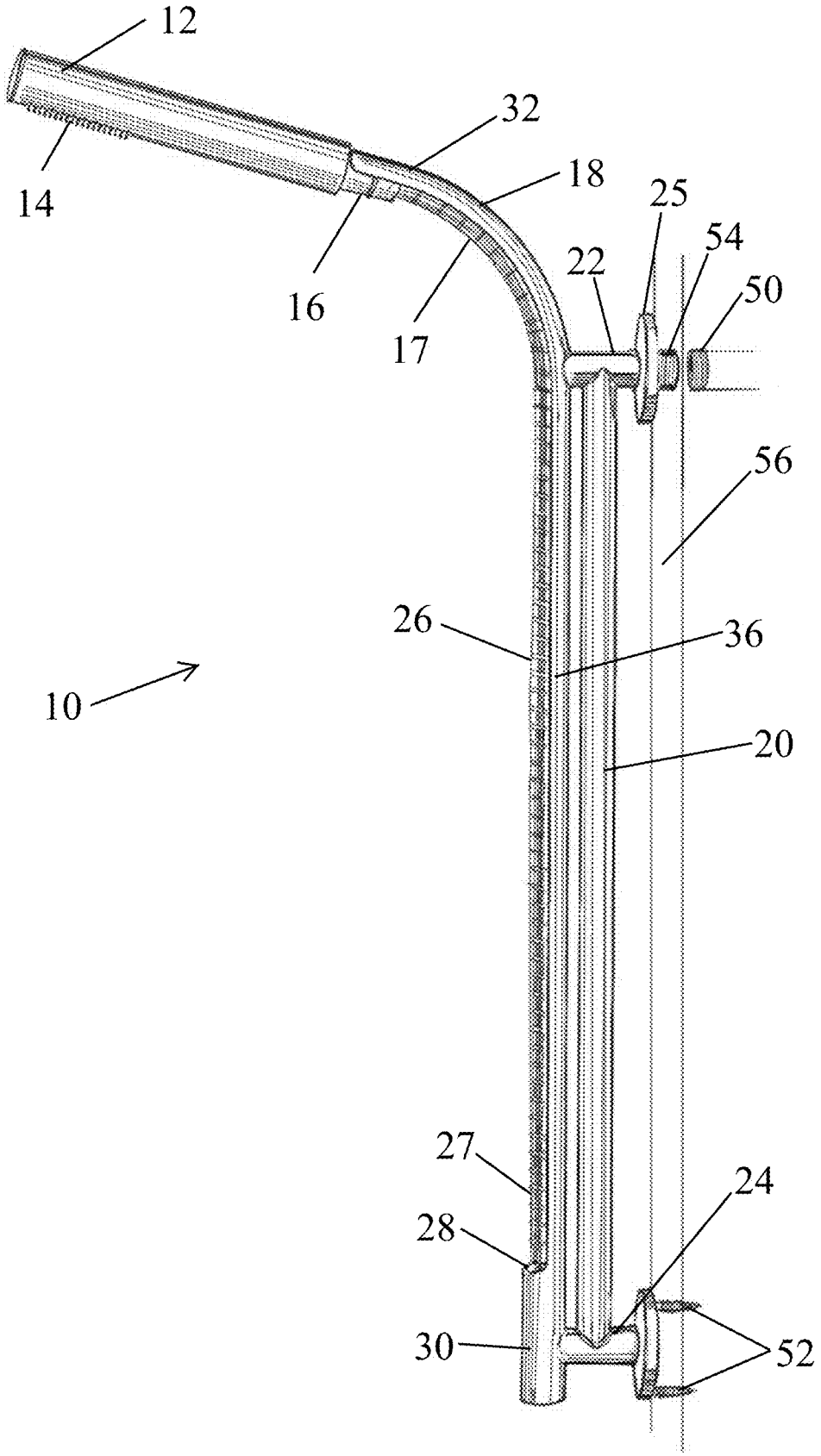
FIG. 2 shows a side view of the shower hose management invention of FIG. 1 revealing a cross section of a shower wall.

Another advantage of the hose management fixture 10 is that it may be easily retrofitted to a standard shower stall. As shown in FIG. 2, for example, the inlet 22 of the riser bar 20 includes a nipple 54 on the upper end 25 of the hose management fixture 10. The nipple 54 is configured to connect to a plumbing drop ear 50 that is pre-existing within a shower wall 56. Plumbing drop ears 50 are installed when a typical stand-up shower stall is constructed. A traditional shower arm in a pre-existing shower installation may simply be disconnected from the existing drop ear 50. The nipple 54 on the riser bar 20 may then be attached to the drop ear 50 and connected to the inlet 22 on the upper end 25 of the hose management fixture 10.

On the lower end 24 of the hose management fixture 10, opposite the upper end 25, any type of fastening device may be used to affix the lower end 24 of the riser bar 20 to the wall 56. Preferably, and as shown in FIG. 2, fasteners 52, such as toggle bolts or screws, may be drilled and secured to the wall 56 to retain the riser bar 20 in place. The lower end 24 of the hose management fixture 10 therefore is not connected to plumbing within the wall 56. Only the nipple 54 attaches to existing plumbing within the wall 56 through an existing penetration, thereby eliminating the need to open the wall 56 when installing the hose management fixture 10.

Figure 3:
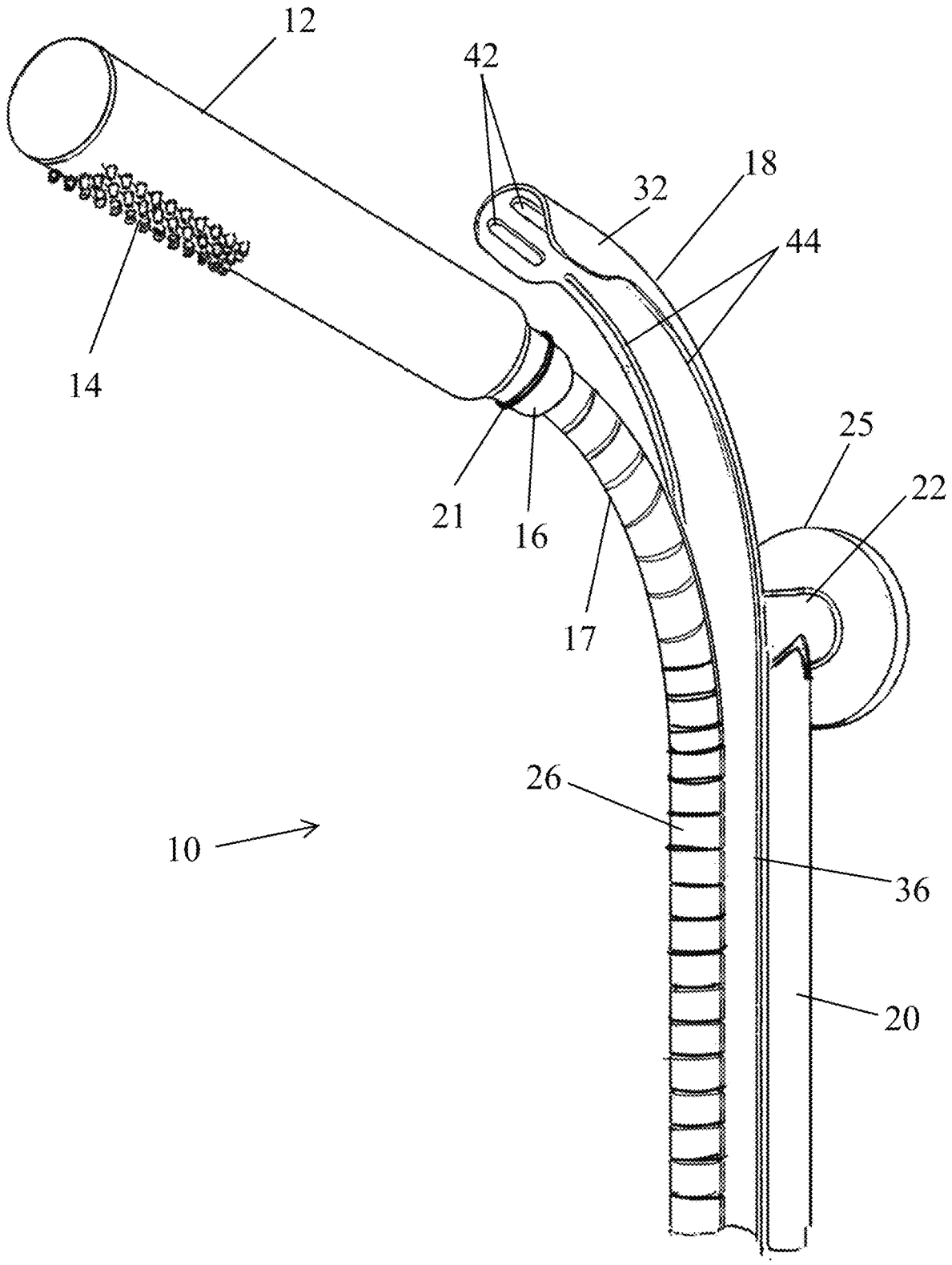
FIG. 3 shows a perspective, close-up view of a hand-held shower wand of the shower hose management invention of FIG. 1 separated from the docking cradle according to a first embodiment.

There are different embodiments of the hose management fixture 10 envisioned. For example, FIG. 3 shows one embodiment where magnetic pads 42 are located on a second end 32 of the cradle 36. The magnetic pads 42 attract the magnetic hose connection 16 on the hose 26. The attraction between the magnetic pads 42 and the hose connection 16 provides sufficient force to retain the weight of the shower head 12 in place and keep the hose 26 within the cradle 36.

Also shown in FIG. 3 is a pair of magnetic strips 44 that run from a first end of the cradle 36 all the way up to a second end of the cradle 36. The magnetic strips 44 attract the magnetic hose 26 within the valley of the cradle 36 and ensure it remains docked. A bumper 21 on the hose connection 16 may be used to prevent the hose connection 16 from hitting the second end 32 of the cradle 36 with too much force, which may chip or otherwise damage the finish. The bumper 21 may be in the form of an O-ring or other soft cushion.

Figure 4:
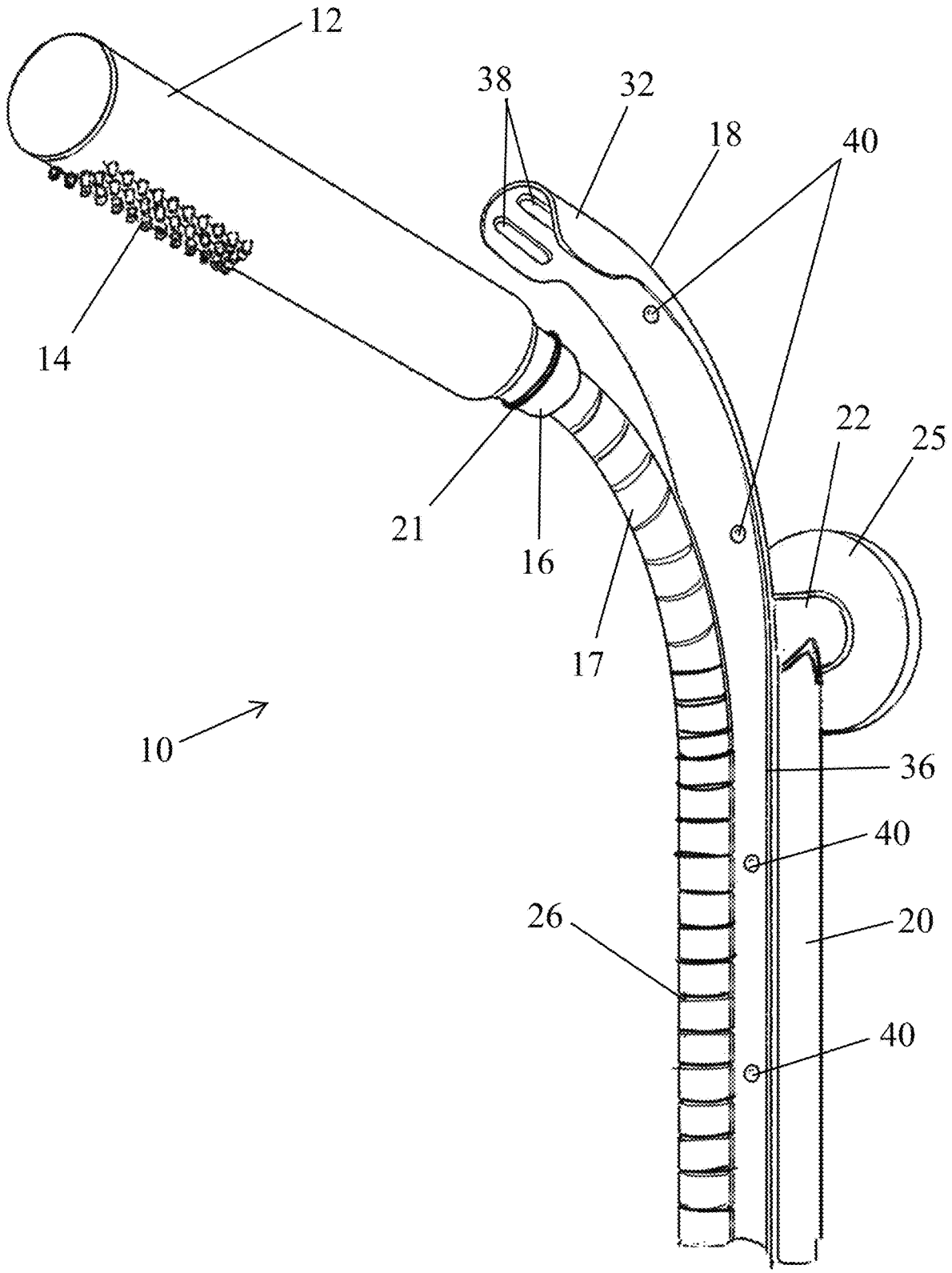
FIG. 4 shows a perspective, close-up view of a hand-held shower wand of the shower hose management invention of FIG. 1 separated from the docking cradle according to a second embodiment.

Turning now to FIG. 4, yet another embodiment of the hose management fixture 10 is shown. In this embodiment, the cradle 36 also includes magnetic pads 38 on the second end 32 of the cradle 36. The magnetic pads 38 function in the same way as with respect to FIG. 3. Instead of magnetic strips 44, as shown in FIG. 3, FIG. 4 shows a plurality of magnets 40 that are intermittently spaced along the length of the cradle 36. There may be magnets 40 simply located on the curved portion 18 allowing the vertical segment of the hose 26 to hang within the cradle unassisted, or the magnets 40 may be placed along the entire length of the cradle 36 from a first end of the cradle 36 to a second end of the cradle 36. As previously mentioned, the magnetic attraction of the magnets 40 and the magnetic pads 38 attracts the hose 26, as the hose 26 is constructed with at least a portion of a magnetic material.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A hand-shower fixture comprising:

a water inlet extending from a drop ear;

a vertically oriented riser bar with a length joined to the water inlet at an upper end and braced to a shower wall at a lower end opposite the upper end;

a hose attachment connected to the lower end of the riser bar;

a flexible hose fluidly coupled to the hose attachment at a first end and fluidly coupled to a shower head at a second end opposite the first end; and a cradle attached to the riser bar and having a curved portion, the cradle configured to engage the hose to keep the hose in a fixed position along at least a portion of the cradle, wherein when the hose is engaged with the cradle, the hose follows the curvature of the curved portion, and when the shower head is held manually, at least a portion of the hose is disengaged from the curved portion of the cradle.

2. The hand-shower fixture according to claim 1, wherein the curved portion of the cradle is located above the water inlet and is configured to curve away from the shower wall to locate the shower head at a horizontal distance from the shower wall that is greater than a horizontal distance between the cradle and the shower wall.

3. The hand-shower fixture according to claim 1, further comprising at least one magnet embedded into a portion of the cradle configured to magnetically attract at least one of the hose and the shower head.

4. The hand-shower fixture according to claim 1, further comprising a valve in fluidic communication with the water inlet configured to regulate both the temperature and the volume of a water flow through the water inlet, wherein the valve is external and not joined to the riser bar.

5. The hand-shower fixture according to claim 1, wherein a portion of the riser bar between the upper end and the lower end provides a pathway for a water flow through the water inlet, into the hose attachment, through the hose, and into the shower head.

6. The hand-shower fixture according to claim 1, wherein the cradle extends alongside and parallel to the riser bar.

7. The hand-shower fixture according to claim 1, wherein the cradle extends the entire length of the riser bar.

8. The hand-shower fixture according to claim 3, wherein the at least one magnet is located only on the curved portion of the cradle.

9. A hand-shower fixture comprising:

a water inlet configured to attach to an existing plumbing attachment in a shower wall;

a linear, straight, vertically oriented riser bar with a length joined to the water inlet with a right angle at an upper end and braced to the shower wall with a right angle at a lower end opposite the upper end;

a hose attachment connected to the lower end of the riser bar with a swivel joint;

a flexible hose fluidly coupled to the hose attachment at a first end and fluidly coupled to a shower head at a second end, opposite the first end; and a cradle parallel to and attached to the riser bar with a substantially U-shaped cross section and a length configured to engage the hose with a magnetic attraction to keep the hose in a fixed position along at least a portion of the cradle, wherein the cradle is elongated along the direction of the riser bar and the substantially U-shaped cross section of the cradle faces outward relative to the shower wall with the riser bar being disposed between the cradle and the shower wall.

10. The hand-shower fixture according to claim 9, further comprising a portion of the cradle, located above the water inlet, configured to extend away from the shower wall to locate the shower head closer to a horizontal plane with respect to the vertically oriented riser bar.

11. The hand-shower fixture according to claim 9, further comprising a magnetic portion on the cradle extending along at least a portion of the length of the cradle.

12. The hand-shower fixture according to claim 9, wherein the hose is one of metallic or impregnated with a magnetically attractive compound.

13. The hand-shower fixture according to claim 9, wherein the shower head is a cylindrical wand configured to engage the cradle at a base of the wand.

14. The hand-shower fixture according to claim 9, wherein the magnetic attraction of the hose to the cradle only occurs at an end of the length of the cradle.

15. A hand-shower fixture comprising:

a water inlet configured to attach to an existing plumbing attachment in a shower wall;

a linear, straight, vertically oriented riser bar with a length joined to the water inlet with a right angle at an upper end and braced to the shower wall with a right angle at a lower end opposite the upper end;

a hose attachment connected to the lower end of the riser bar;

a flexible hose fluidly coupled to the hose attachment at a first end and fluidly coupled to a shower head at a second end, opposite the first end; and a cradle parallel to and attached to the riser bar with a substantially U-shaped cross section, wherein the cradle is elongated along the direction of the riser bar and the substantially U-shaped cross section of the cradle faces outward relative to the shower wall with the riser bar being disposed between the cradle and the shower wall.

16. The hand-shower fixture according to claim 15, wherein the cradle is configured to engage the hose with magnetic attraction to keep the hose in a fixed position along at least a portion of the cradle.

17. The hand-shower fixture according to claim 15, wherein the cradle is configured to retain and engage the hose with an interference fit.

18. The hand-shower fixture according to claim 15, wherein the cradle is configured to engage the hose with both a magnetic attraction and an interference fit.

19. The hand-shower fixture according to claim 15, wherein the shower head is a cylindrical wand configured to engage the cradle at a base of the wand.

20. The hand-shower fixture according to claim 15, wherein the riser bar is configured to replace an existing shower arm with the water inlet.

* * * * *